US009166294B2

(12) United States Patent
Wilson

(10) Patent No.: US 9,166,294 B2
(45) Date of Patent: Oct. 20, 2015

(54) QUAD-BAND PCB ANTENNA

(75) Inventor: David Wilson, Toronto (CA)

(73) Assignee: TYCO SAFETY PRODUCTS CANADA LTD., Concord, Ontario (CA)

( * ) Notice: Subject to any disclaimer, the term of this patent is extended or adjusted under 35 U.S.C. 154(b) by 600 days.

(21) Appl. No.: 12/748,804

(22) Filed: Mar. 29, 2010

(65) Prior Publication Data

US 2010/0245198 A1 Sep. 30, 2010

Related U.S. Application Data

(60) Provisional application No. 61/165,070, filed on Mar. 31, 2009.

(51) Int. Cl.

| | |
|---|---|
| ***H01Q 1/38*** | (2006.01) |
| ***H01Q 1/48*** | (2006.01) |
| ***H01Q 13/10*** | (2006.01) |
| ***H01Q 9/06*** | (2006.01) |
| ***H01Q 9/04*** | (2006.01) |
| ***H01Q 1/24*** | (2006.01) |
| ***H01Q 9/42*** | (2006.01) |
| ***H01Q 5/20*** | (2015.01) |
| ***H01Q 5/357*** | (2015.01) |

(52) U.S. Cl.

CPC ..... *H01Q 9/0442* (2013.01); *H01Q 1/243* (2013.01); *H01Q 1/38* (2013.01); *H01Q 5/20* (2015.01); *H01Q 5/357* (2015.01); *H01Q 9/42* (2013.01); *H01Q 13/10* (2013.01)

(58) Field of Classification Search

CPC ... H01Q 9/0442; H01Q 13/10; H01Q 5/0051; H01Q 9/42; H01Q 5/001; H01Q 1/243; H01Q 1/38; H01Q 5/0024

USPC ..... 343/767, 700 MS, 702

See application file for complete search history.

(56) References Cited

U.S. PATENT DOCUMENTS

| | | | |
|---|---|---|---|
| 6,466,176 | B1 | 10/2002 | Maoz et al. |
| 6,741,214 | B1 | 5/2004 | Kadambi et al. |
| 7,277,337 | B1 | 10/2007 | Co et al. |
| 7,339,531 | B2 | 3/2008 | Desclos et al. |
| 7,372,406 | B2 | 5/2008 | Shiotsu et al. |
| 7,388,543 | B2 | 6/2008 | Vance |

(Continued)

FOREIGN PATENT DOCUMENTS

| | | |
|---|---|---|
| WO | 03/010854 | 2/2003 |
| WO | 2005/112280 | 11/2005 |
| WO | 2009/028251 A1 | 3/2009 |

OTHER PUBLICATIONS

International Search Report and Written Opinion dated Jul. 22, 2010 for International Application No. PCT/CA2010/000489, International Filing Date Mar. 31, 2010 (9 pages).

(Continued)

*Primary Examiner* — Hoang V Nguyen
*Assistant Examiner* — Michael Bouizza
(74) *Attorney, Agent, or Firm* — Kacvinsky Daisak Bluni PLLC

(57) ABSTRACT

A surface mount antenna includes a ground plane, a feed line, and a radiating element. The ground plane extends in a first direction on a first side of a substrate. The feed line extends in a second direction on a second side of the substrate. The radiating element includes a plurality of segments disposed on the first side of the substrate and is configured to resonate in a plurality of frequency modes.

18 Claims, 5 Drawing Sheets

(56) References Cited

U.S. PATENT DOCUMENTS

| | | | | |
|---|---|---|---|---|
| 2003/0112195 | A1 | 6/2003 | Cheng et al. | |
| 2003/0151555 | A1 | 8/2003 | Holshouser | |
| 2004/0119648 | A1* | 6/2004 | Ghosh et al. | 343/700 MS |
| 2007/0103367 | A1 | 5/2007 | Wang | |
| 2007/0126640 | A1 | 6/2007 | Lee | |
| 2007/0139270 | A1 | 6/2007 | Takei et al. | |
| 2007/0222697 | A1 | 9/2007 | Caimi et al. | |
| 2008/0111745 | A1* | 5/2008 | Takada et al. | 343/700 MS |
| 2008/0180333 | A1 | 7/2008 | Martiskainen et al. | |
| 2009/0079647 | A1 | 3/2009 | Jung et al. | |
| 2009/0174606 | A1 | 7/2009 | Qian et al. | |
| 2010/0245195 | A1 | 9/2010 | Wilson | |
| 2011/0109515 | A1* | 5/2011 | Rao | 343/702 |

OTHER PUBLICATIONS

Canadian Intellectual Property Office, International Search Report, Completed: Jun. 11, 2010 for International Application No. PCT/CA2010/000490; by Authorized Officer: Kazem Ziaie.

Office Action for U.S. Appl. No. 12/748,605; USPTO Mailing date Dec. 18, 2012.

Supplementary European Search Report, dated Apr. 4, 2014 for European Patent Application No. 10747972.4 filed Mar. 31, 2010.

* cited by examiner

QUAD-BAND PCB ANTENNA

CROSS-REFERENCE TO RELATED APPLICATION

This application claims the priority benefits of U.S. provisional Application No. 61/165,070 filed Mar. 31, 2009 the entire disclosure of which is herein incorporated by reference.

BACKGROUND OF THE INVENTION

1. Field of the Invention

Embodiments of the present disclosure relate to surface mount antennas that may be disposed on printed circuit boards (PCBs). More particularly, the present disclosure relates to a quad-band antenna that may be surface mounted on PCBs.

2. Discussion of Related Art

Security or alarm systems are installed in premises to detect hazardous or potentially hazardous conditions. A security system generally includes a plurality of detectors/sensors, one or more keypads, and a control panel containing the system electronics and may include a communication interface (communicator) for remote monitoring and two-way communication over telephone or wireless communication paths. Each of the detectors communicates with the control panel to provide notification of an alarm condition. Examples of possible alarm conditions include unauthorized entry or the unexpected presence of a person who may be an intruder, fire, smoke, toxic gas, high/low temperature conditions (e.g., freezing), flooding, power failure, etc. In other words, an alarm condition may represent any detectable condition that might lead to personal hazard or property damage. Audible and/or visible alarm devices such as sirens, lights, etc., may also be utilized to notify occupants of the existence of an alarm condition. The control panel may be located in a utility room, basement, etc., and may communicate with the detectors and notification devices by wired or wireless signal paths. A keypad, which may also communicate with the control panel via a wired or wireless connection, is used to arm/disarm the system as well as providing a means to display various system messages via a status display screen.

FIG. 1 is a block diagram of a typical security system 10 installed in a building or premises. Security system 10 includes a control panel 20 which generally controls operation of the system. A number of detection devices $\mathbf{18}_1 \ldots \mathbf{18}_N$ are utilized to monitor an area. Detection devices may include, for example, motion detectors, door contacts, glass break detectors, smoke detectors, water leakage detectors, gas detectors, etc. Detection devices $\mathbf{18}_1 \ldots \mathbf{18}_N$ communicate with panel 20 by a dedicated wired interconnect 18A, wirelessly 18B, through the electric (i.e. power) wiring of the premises 18C, or otherwise. One or more user interfaces, such as keypad 25, is used to communicate with control panel 20 to arm, disarm, notify, and generally control system 10.

Control panel 20 communicates with each of the detection devices $\mathbf{18}_1 \ldots \mathbf{18}_N$, keypad 25 and personal device 19 as well as communicating with an offsite monitoring service 30 which is typically geographically remote from the monitored premises in which system 10 is installed. Control panel 20 may include a CPU 34, memory 35, and communicator 36. CPU 34 functions as a controller to control the various communication protocols within system 10. Memory 35 stores system parameters, detection device information, address information, etc. Communicator 36 sends and receives signals to/from the monitoring facility 30 via communications link 31. Alternatively, communicator 36 may be a separate device that communicates with controller 20 via a hardwired or wireless connection.

Generally, when an alarm condition occurs based on the operation of one or more detection devices $\mathbf{18}_1 \ldots \mathbf{18}_N$, a signal is transmitted from the respective detection device to control panel 20. Depending on the type of signal received from the one or more detection devices, communicator 36 communicates with monitoring service 30 via link 31 to notify the monitoring service that an alarm notification has occurred at the premises. Communication link 31 may be a POTS (Plain Old Telephone System) connection, a broadband connection (e.g., internet), a cellular link such as GSM (Global System for Mobile communications) transmission, satellite communication, etc. In certain security systems, keypad 25, control panel 20 and communicator 36 may be housed within a single unit.

For wireless communication, the keypad 25, control panel 20, communicator 36, and detection devices $\mathbf{18}_1 \ldots \mathbf{18}_N$ include an antenna for transmitting and receiving signals. However, the size of communicator 36 and other components of the security system are continually being decreased in order for the devices to be unobtrusively installed in various areas of the home or business. For security providers that do business throughout the world, the decreasing sizes of the components of the security system, and consequently the PCBs within the components, often requires the design and manufacture of separate PCBs due to the different bands used for wireless communication in these different regions. For example, security units in North America typically operate in the Global System for Mobile Communications (GSM) 850 and GSM900 bands, and security units in Europe typically operate in the GSM1800 and GSM1900 bands. Accordingly, a compact quad-band surface mount antenna is desirable that can accommodate different GSM bands.

SUMMARY OF THE INVENTION

Exemplary embodiments of the present disclosure are directed to a planar antenna including a ground plane, a feed line, and a radiating element. The ground plane extends in a first direction on a first side of a substrate. The feed line extends in a second direction on a second side of the substrate The radiating element comprising a plurality of portions disposed on the first side of the substrate and the feed line is configured to excite at least one of said plurality of portions to resonate in a corresponding one of a plurality of frequency bands.

In another exemplary embodiment, a planar antenna includes a ground plane that extends in a first direction along a first surface of a printed circuit board (PCB). A feed line extends in a second direction along a second surface of the PCB. A radiating element is disposed on the first surface of the PCB and is configured to resonate in any one of at least three modes, the mode depending on an input signal frequency radiating element. The radiating element comprising a first portion extending from the ground plane, a second portion extending from the first portion, a third portion extending from the second portion, and a fourth portion extending from the third portion.

In another exemplary embodiment, an antenna includes a ground plane, a feed line, and a radiating element. The ground plane extends in a first direction along a first surface of a substrate. The feed line extends in a second direction along a second surface of the substrate. The radiating element is disposed on the first surface of the substrate and is configured to resonate in any one of at least three modes. The radiating element includes a first portion extending from the ground plane in the second direction, a second portion extending from the first portion in the first direction, a third portion extending from the second portion in the second direction, and a fourth portion extending from the third portion in a substantially perpendicular direction.

DESCRIPTION OF EMBODIMENTS

Figure 1:
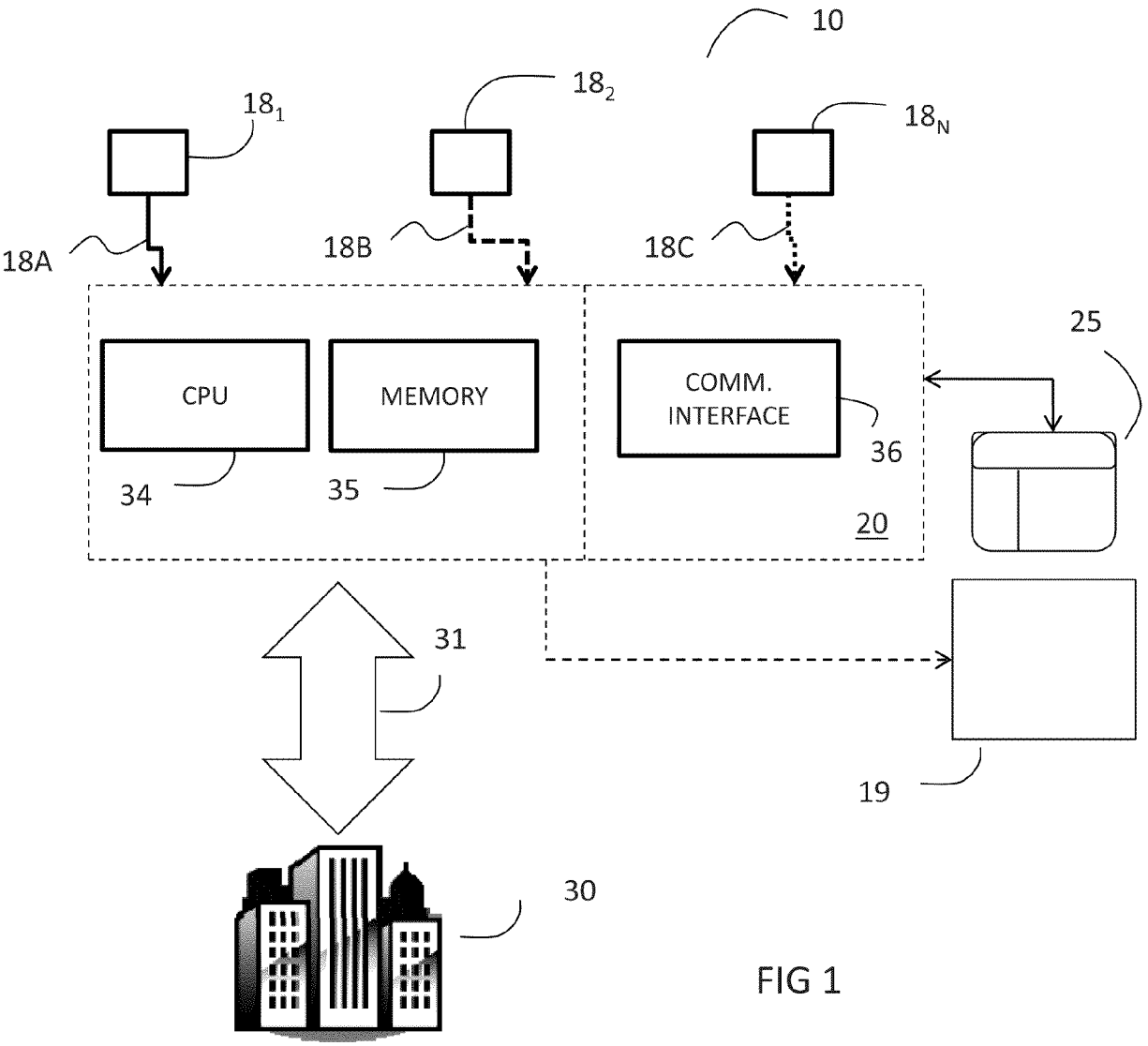
FIG. 1 illustrates a block diagram of a security system.

The present disclosure will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

Figure 2:
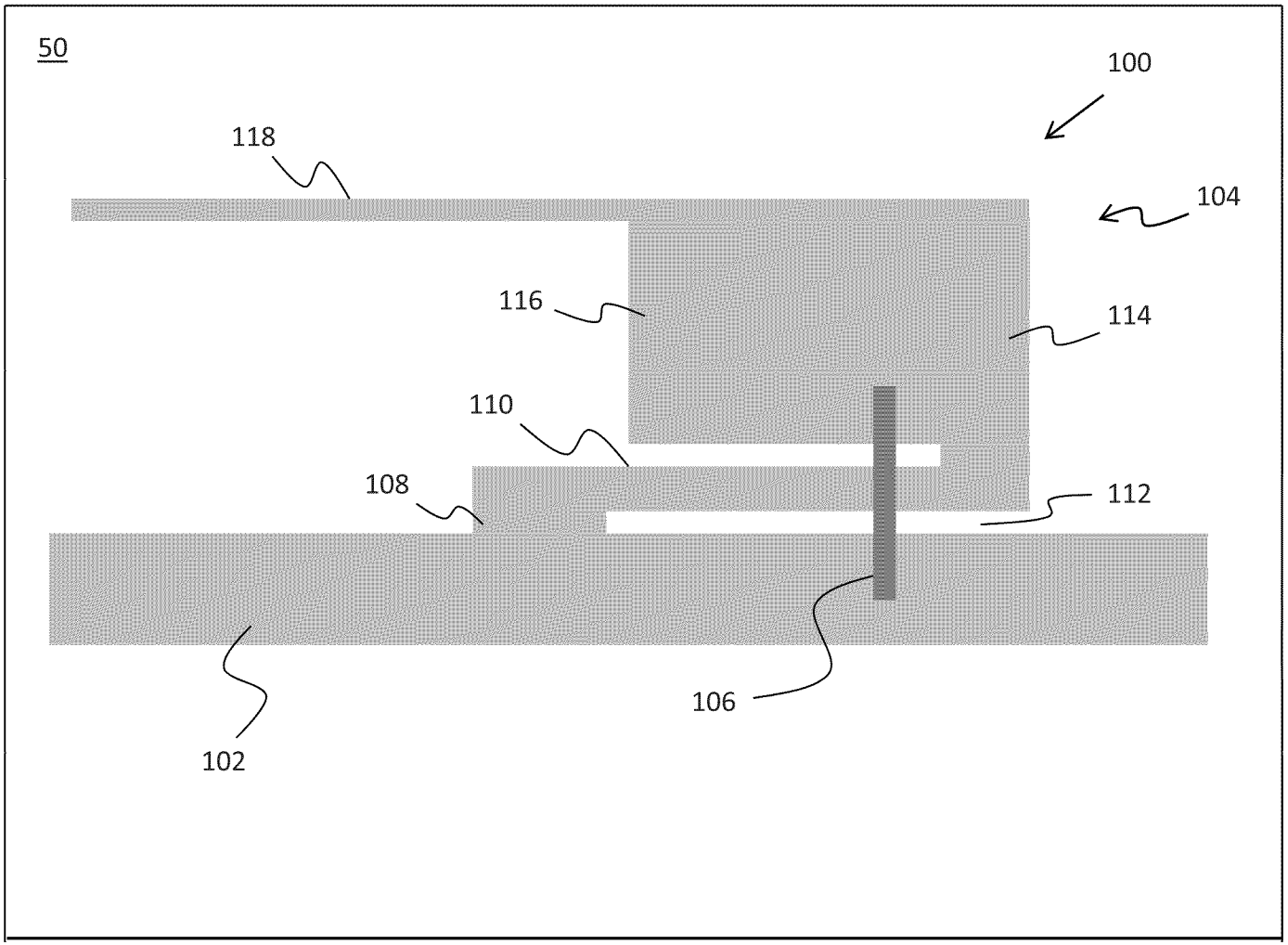
FIG. 2 illustrates a layout of a quad-band surface mount antenna.

FIG. 2 is a layout of one example of a quad-band surface mount antenna 100 used for transmitting and receiving wireless communication signals. Antenna 100 may be disposed on a dielectric substrate 50 such as a printed circuit board (PCB). Antenna 100 includes a ground plane 102 and radiating element 104 disposed on one side of a substrate or PCB 50 and a feed line 106 disposed on an opposite side of the substrate 50. Radiating element 104 includes a first portion 108 extending from ground plane 202 in a substantially perpendicular direction with respect to the direction in which ground plane 102 extends across PCB 50. A second portion 110 of radiating element 104 extends from first portion 108 in a substantially perpendicular direction such that second portion 110 may extend parallel to ground plane 102 and defines a non-conducting slot 112 with ground plane 102.

A third portion 114 of radiating element 104 extends from second portion 110 in a substantially perpendicular direction such that it is substantially parallel with first portion 108. Third portion 114 includes an enlarged portion 116 having a substantially rectangular geometry. However, third portion 114 may have alternative geometries based on the desired configuration of radiation element 104. Fourth portion 118 extends from third portion 114 in a substantially perpendicular direction and is substantially parallel with ground plane 102 and second portion 110.

As will be described in more detail with reference to FIGS. 2A-2C, by utilizing various active portions of the layout of antenna 100, quad-band operation is provided using only a single feed line 106 in three resonant modes. One resonant mode may be, for example, for use in the Global System for Mobile Communications (GSM) 850 and GSM900 frequency bands. The GSM850 frequency band is between 824-849 MHz for uplink and between 869-894 MHz for downlink, and the GSM900 frequency band is between 890-915 MHz for uplink and 935-960 MHz for downlink for a total bandwidth of 136 MHz.

Figure 2A:
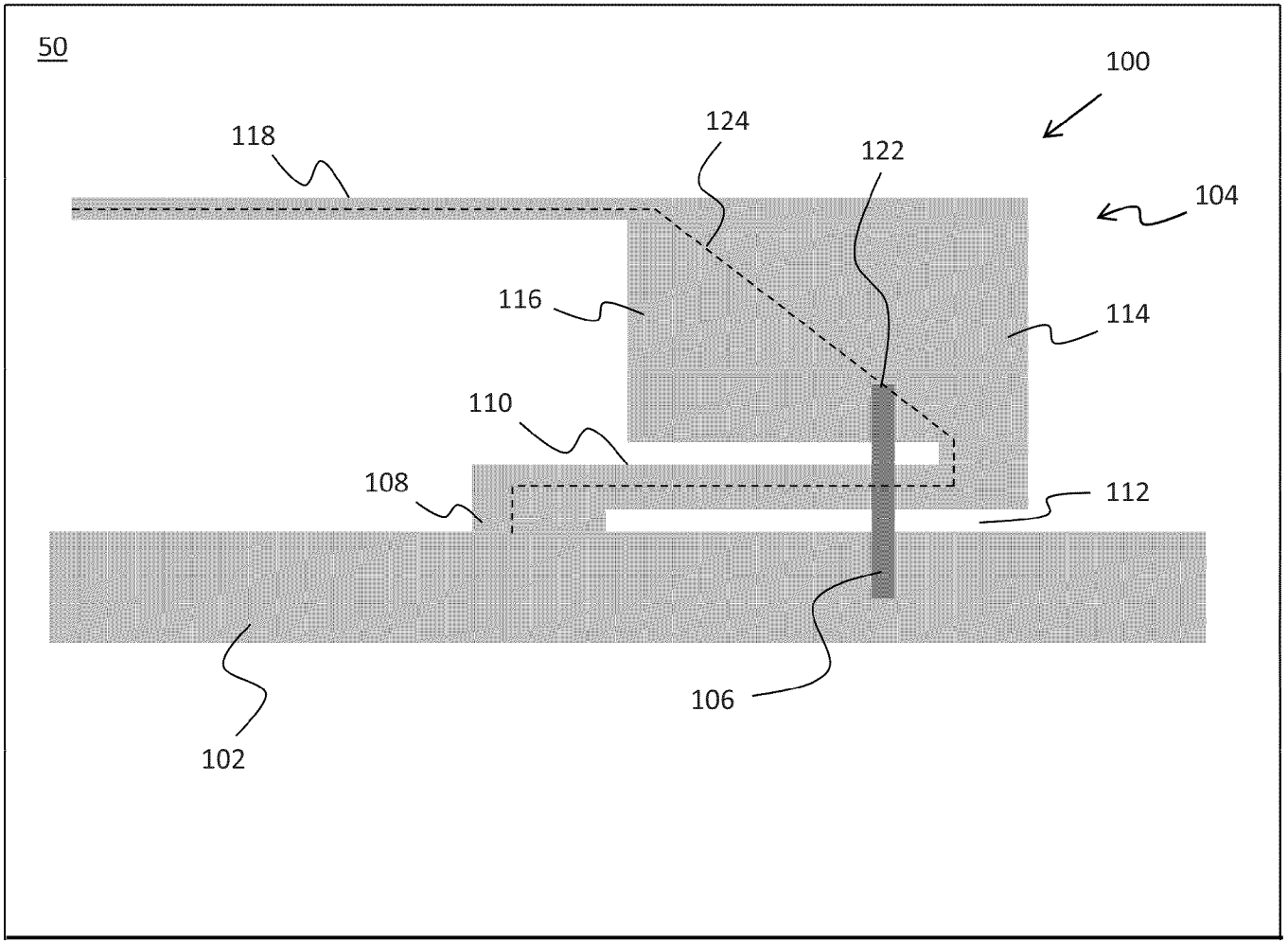
FIG. 2A illustrates the quad-band surface mount antenna operating in a first resonant mode.

FIG. 2A illustrates an exemplary configuration of the active portion of antenna 100 when operating in a first resonant mode. The active portion of antenna 100 is identified by dashed line 124 which extends from ground plane 102 to fourth portion 118 of radiating element 104. The active portion of antenna 100 for the first resonant mode intersects feed line 106 at point 122 such that a partial wavelength radiating element 124, which in this example is a ¼ wavelength, is disposed adjacent to the intersection point 122 and extends across the third and fourth portions 116, 118 of radiating element 104. As will be understood by one skilled in the art, the length of partial radiating element 124 may be adjusted to resonate in response to signals having frequencies greater than or less than those of GSM850 and GSM950 frequency bands.

Figure 2B:
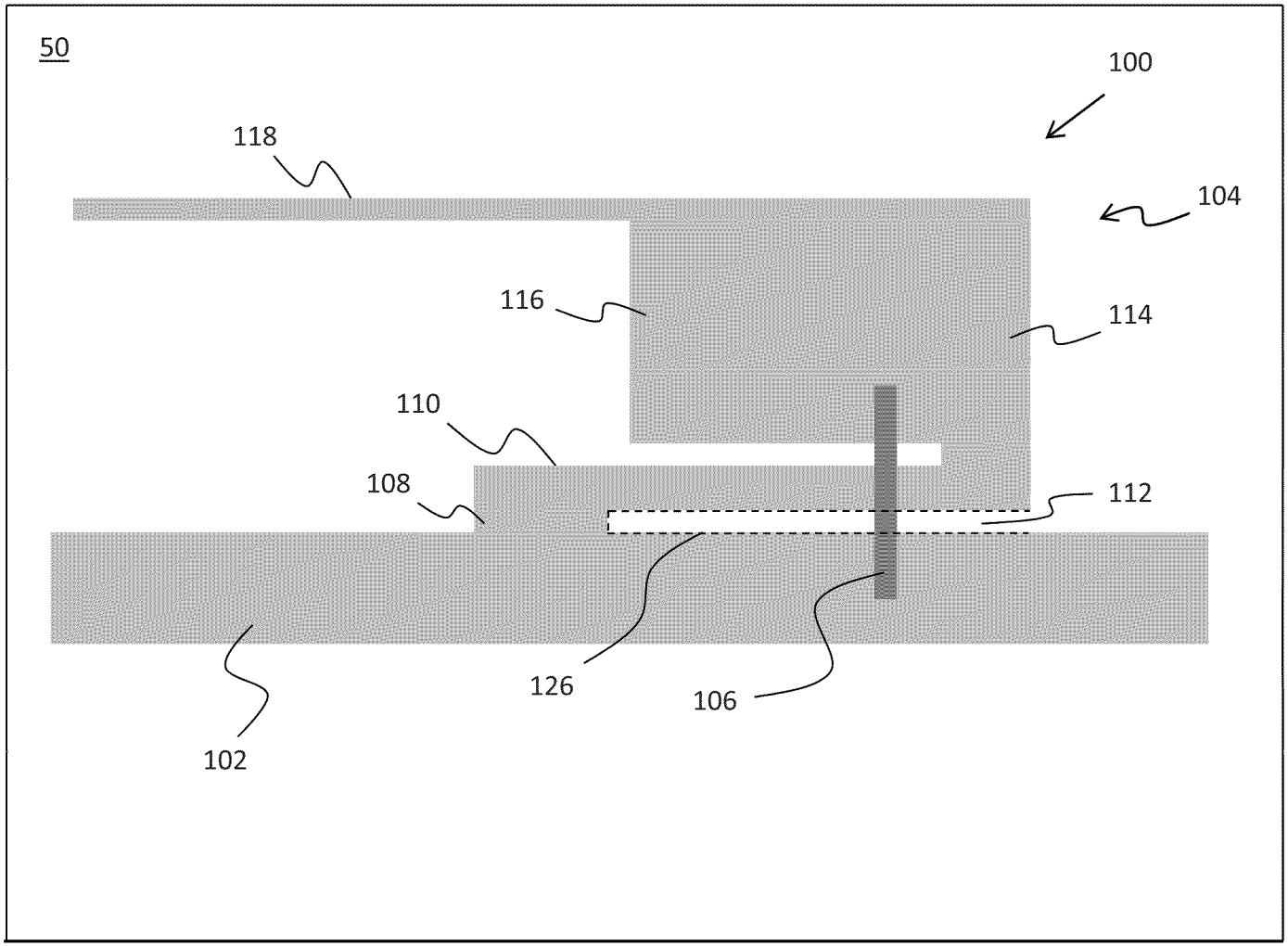
FIG. 2B illustrates the quad-band surface mount antenna operating in a second resonant mode.

FIG. 2B illustrates an exemplary configuration of the active portion 126 of antenna 100 when antenna 100 is operating in a second resonant mode, which may be, for example, in response to signals in the GSM1850 band. As shown in FIG. 2B, active portion 126 extends along the perimeter of slot 112 defined by ground plane 102 and the first and second portions 108, 110 of radiating element 104. Active portion 126 forms a ¼ wavelength radiating element excited by the feed line 106 disposed on the opposite side of the PCB 50. The frequency at which active portion 126 resonates may be adjusted by increasing or decreasing the perimeter of slot 112.

Figure 2C:
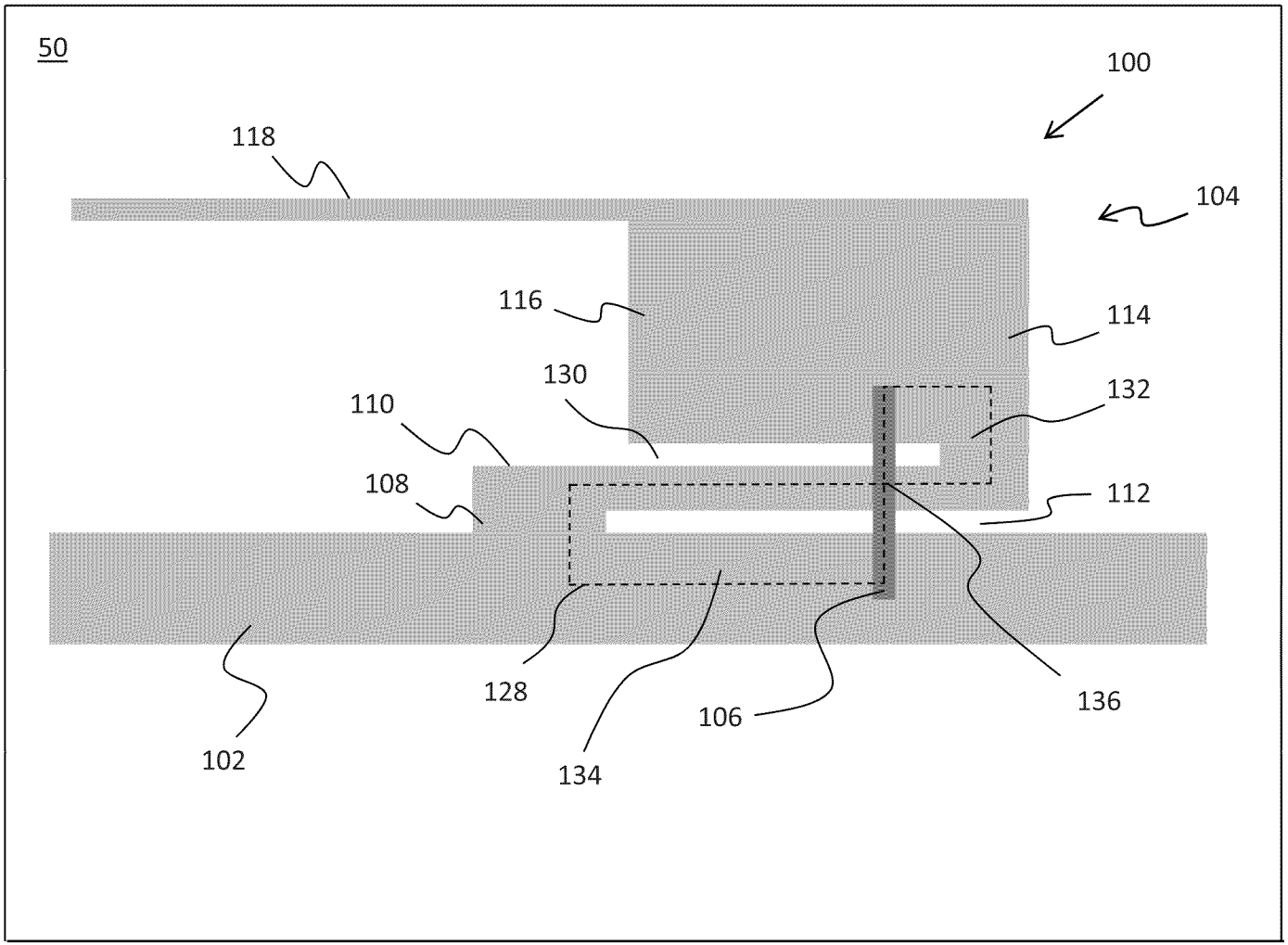
FIG. 2C illustrates the quad-band surface mount antenna operating in a third resonant mode.

FIG. 2C illustrates an exemplary configuration of the active portion 128 of antenna 100 when antenna 100 is operating in a third resonant mode, which may be, for example, in response to signals having a frequency in accordance with the GSM1900 frequency band. Active portion 128 of radiating element 104 is a ½ wavelength loop, however alternative configurations may be employed based on the desired frequency. As shown in FIG. 2C, active portion 128 extends along first and second portions 108, 110 of radiating element 104 and partially along third portion 114 that defines slot 130 with second portion 112. Feed line 106 also resonates as a part of active portion 128 such that active portion 128 has a shape defining a pair of rectangles 132 and 134, which are coupled together at point 136 where feed line 110 intersects second portion 110 of radiating element 104.

The antenna 100 disclosed herein advantageously resonates in three resonant modes to provide quad-band operation while having a compact design. Antenna 100 enables security system providers and other organizations providing wireless communications, a compact surface mount antenna disposed on a PCB that may be utilized in various regions to accommodate wireless transmission in different frequency bands.

While the present invention has been disclosed with reference to certain embodiments, numerous modifications, alterations and changes to the described embodiments are possible without departing from the sphere and scope of the present disclosure, as defined in the appended claims. Accordingly, it is intended that the present invention not be limited to the described embodiments, but that it has the full scope defined by the language of the following claims, and equivalents thereof.

What is claimed is:

1. A planar antenna, comprising:

a ground plane on a first surface of a substrate;

a radiating element on the first surface of the substrate, the radiating element comprising:

a first portion connected to and extending directly from the ground plane, a second portion extending from the first portion, a third portion extending from the second portion, and a fourth portion extending directly from the third portion; and a feed line on a second surface of the substrate with portions of the substrate being sandwiched between the feed line and each of the ground plane, the second portion, and the third portion, said feed line configured to excite at least one of said first, second, third, and fourth portions to resonate in a corresponding one of a plurality of frequency bands.

2. The planar antenna of claim 1, wherein each of the first, second, third, and fourth portions of the radiating element are active when the antenna resonates in a first resonant mode.

3. The planar antenna of claim 2, wherein the antenna resonates in the first resonant mode in response to transmitting or receiving signals in accordance with at least one of a Global System for Mobile communications (GSM) 850 or 900 frequency band.

4. The planar antenna of claim 2, wherein the ground plane and the first and second portions of the radiating element define a slot, and wherein a perimeter of the slot is active when the antenna resonates in a second resonant mode.

5. The planar antenna of claim 4, wherein the antenna resonates in the second resonant mode in response to transmitting or receiving signals in accordance with a Global System for Mobile communications (GSM) 1800 frequency band.

6. The planar antenna of claim 4, wherein the ground plane, the first and second portions of the radiating element, and a first section of the third portion of the radiating element are active when the antenna resonates in a third resonant mode.

7. The planar antenna of claim 6, wherein the antenna resonates in the third resonant mode in response to transmitting or receiving signals in accordance with a Global System for Mobile communications (GSM) 1900 frequency band.

8. A planar antenna, comprising:

a ground plane extending in a first direction along a first surface of a printed circuit board (PCB);

a radiating element disposed on the first surface of the PCB and configured to resonate in any one of at least three modes, the mode depending on an input signal frequency, the radiating element comprising:

a first portion connected to and extending directly from the ground plane, a second portion extending from the first portion, a third portion extending from the second portion, and a fourth portion extending directly from the third portion; and a feed line extending in a second direction along a second surface of the PCB with portions of the PCB being sandwiched between the feed line and each of the ground plane, the second portion, and the third portion.

9. The planar antenna of claim 8, wherein the first, second, third, and fourth portions of the radiating element define a ¼ wavelength radiating element when the antenna resonates in a first resonant mode.

10. The planar antenna of claim 9, wherein the antenna resonates in the first resonant mode in response to transmitting or receiving signals in accordance with a Global System for Mobile communications (GSM) 850 or a GSM900 frequency band.

11. The planar antenna of claim 8, wherein the ground plane and the first and second portions of the radiating element define a slot, and wherein a perimeter of the slot is active to define a ¼ wavelength radiating element when the antenna resonates in a second resonant mode.

12. The planar antenna of claim 11, wherein the antenna resonates in the second resonant mode in response to transmitting or receiving signals in accordance with a Global System for Mobile communications (GSM) 1800 frequency band.

13. The planar antenna of claim 8, wherein the ground plane, the first and second portions of the radiating element, and a first section of the third portion of the radiating element are active to define a ¼ wavelength radiating element when the antenna resonates in a third resonant mode.

14. The planar antenna of claim 13, wherein the antenna resonates in the third resonant mode in response to transmitting or receiving signals in accordance with a Global System for Mobile communications (GSM) 1900 frequency band.

15. An antenna, comprising:

a ground plane extending in a first direction along a first surface of a substrate;

a radiating element disposed on the first surface of the substrate and configured to resonate in at least three modes, the radiating element comprising:

a first portion connected to and extending directly from the ground plane in a second direction, a second portion extending from the first portion in the first direction, a third portion extending from the second portion in the second direction, and a fourth portion extending directly from the third portion in a substantially perpendicular direction; and a feed line extending in the second direction along a second surface of the substrate with portions of the substrate being sandwiched between the feed line and each of the ground plane, the second portion, and the third portion.

16. The antenna of claim 15, wherein the first, second, third, and fourth portions of the radiating element define a ¼ wavelength radiating element when the antenna resonates in a first resonant mode in response to transmitting or receiving signals in accordance with a Global System for Mobile communications (GSM) 850 or a GSM900 frequency band.

17. The antenna of claim 16, wherein the ground plane and the first and second portions of the radiating element define a slot, and wherein a perimeter of the slot is active to define a ¼ wavelength radiating element when the antenna resonates in a second resonant mode in response to transmitting or receiving signals in accordance with a GSM1800 frequency band.

18. The antenna of claim 17, wherein the ground plane, the first and second portions of the radiating element, and a first section of the third portion of the radiating element are active to define a ¼ wavelength radiating element when the antenna resonates in a third resonant mode in response to transmitting or receiving signals in accordance with a GSM 1900 frequency band.

* * * * *